US007154369B2

(12) United States Patent
Dietz et al.

(10) Patent No.: US 7,154,369 B2
(45) Date of Patent: Dec. 26, 2006

(54) PASSIVE THERMAL SWITCH

(75) Inventors: Douglas W. Dietz, Rancho Palos Verdes, CA (US); Louis C. Moe, Fountain Valley, CA (US); Leah O. Valmidiano, Carson, CA (US); Mark R. Franklin, Valencia, CA (US); Tony C. Chiang, Oak Park, CA (US); Dominic S. Nuccitelli, Granada Hills, CA (US)

(73) Assignee: Raytheon Company, Waltham, MA (US)

( * ) Notice: Subject to any disclaimer, the term of this patent is extended or adjusted under 35 U.S.C. 154(b) by 306 days.

(21) Appl. No.: 10/866,224

(22) Filed: Jun. 10, 2004

(65) Prior Publication Data

US 2005/0275500 A1 Dec. 15, 2005

(51) Int. Cl.
*H01H 37/48* (2006.01)
*F28F 27/00* (2006.01)
*F25D 29/00* (2006.01)

(52) U.S. Cl. ..... 337/394; 165/276; 62/383

(58) Field of Classification Search ..... 337/298, 337/392–394, 299; 361/709, 710; 165/276; 62/383

See application file for complete search history.

(56) References Cited

U.S. PATENT DOCUMENTS 3,306,075 A * 2/1967 Cowans ..... 62/51.1
3,531,752 A * 9/1970 Gourley ..... 337/139
4,770,004 A 9/1988 Lagodmos
5,379,601 A * 1/1995 Gillett ..... 62/51.1
5,682,751 A * 11/1997 Langhorn et al. ..... 62/51.1
5,842,348 A * 12/1998 Kaneko et al. ..... 62/51.1
6,276,144 B1 8/2001 Marland et al.
6,305,174 B1 10/2001 Binneberg
6,438,967 B1 * 8/2002 Sarwinski et al. ..... 62/6
6,829,145 B1 * 12/2004 Corrado et al. ..... 361/704

OTHER PUBLICATIONS

NASA Facts, "Cryogenic Thermal Storage Unit Flight Experiment", FS-1998-09-025-GSFC, Sep. 1998.
Autonomous Thermal Switches, "Redundant Solutions for Cryogenic Thermal Management Systems".
NASA's Jet Propulsion Laboratory, Pasadena, California, Magnetostrictive Heat Switch for Cryogenic Use.
NASA, Payloads, Cryogenic Thermal Storage Unit (CRYOTSU).

* cited by examiner

*Primary Examiner*—Anatoly Vortman
(74) *Attorney, Agent, or Firm*—Leonard A. Alkov; Karl A. Vick

(57) ABSTRACT

A thermal switch selectively couples a heat source to a pair of heat sinks. The thermal switch includes a shunt that is thermally coupled to the heat source. The shunt has a pair of posts. End portions of the posts are at least partially radially surrounded by respective cups. The cups in turn are thermally coupled to respective of the heat sinks. The cups are made of a material with a larger coefficient of thermal expansion than the material of the posts. Activation of one of the heat sinks causes the cup corresponding to that heat sink to contract, bringing it into contact with the corresponding post of the shunt. This opens a heat path through the switch from the heat source to the activated heat sink. Thermal isolation of the second cup is facilitated by an axial isolator of high thermal impedance, facilitating isolation of the inactive heat sink.

24 Claims, 6 Drawing Sheets

PASSIVE THERMAL SWITCH

RIGHTS IN INVENTION

This invention was made with support under Government Contract No. DAAH01-00-C-0107 with the Department of the Army. The U.S. Government may have certain rights to this invention.

BACKGROUND OF THE INVENTION

1. Technical Field of the Invention

The invention is related to the field of thermal switches for selectively providing a low thermal impedance path.

2. Background of the Related Art

It is sometimes desirable to provide selective heat flow between two points, by use of a thermal switch. Such thermal switches ideally involve a large difference in thermal impedance between when the switch is "on" (low thermal impedance desired) and when the switch is "off" (high thermal impedance desired). Also, it will be appreciated that it would be desirable for such switches to be reliable, light in weight, low in complexity, and require no additional external power for activation.

A concentric thermal switch based on the principle of differential radial thermal contraction is described in Binneberg et al., U.S. Pat. No. 6,305,174. However the device of Binneberg meets only one of the above criteria, failing to provide a high redundant impedance in the "off" state due to heat leaks through the small spacers used to maintain a gap between the concentric bodies.

Another prior art device is that descried in Marland et al., U.S. Pat. No. 6,276,144. The device described in Marland employs the principle of axial thermal contraction to cause switch engagement. Though referred to as a thermal switch, this device is actually a thermostat that does not provide the necessary directionality to enable selective coupling to one of a pair of heat sinks.

From the foregoing it will be appreciated that there is room for improvements in thermal switches.

SUMMARY OF THE INVENTION

According to one aspect of the invention, a thermal switch includes: a post thermally coupled to a heat source; a cup thermally coupled to a heat sink, wherein the cup includes an annular portion at least partially surrounding a portion of the post, leaving a gap therebetween; and an axial isolator coupled to the cup and the post, for maintaining the radial gap between the post and the annular portion of the cup. The cup and the post have different coefficients of linear thermal expansion, such that the post and the annular portion selectively thermally couple together depending on temperatures of the annular portion and the post.

According to another aspect of the invention, a thermal switch includes: a shunt thermally coupled to a heat source, wherein the shunt includes having a pair of posts thermally coupled to one another; a pair of cups thermally coupled to respective heat sinks, wherein the cups include respective annular portions at least partially surrounding portions of the posts, leaving respective gaps therebetween; and a pair of an axial isolators coupling the cups to the respective posts, for maintaining the radial gaps between the posts and the annular portions of the cups. The annular portions have a lower coefficient of thermal expansion than the shunt, such that the posts and the annular portion selectively thermally couple together depending on temperatures of the annular portions and the posts.

According to yet another aspect of the invention, a method of selectively coupling a heat source to one of a pair of heat sinks includes the steps of: thermally coupling the heat source to a shunt; radially contracting a first cup at least partially around a first post of a shunt, thereby causing contact between the first cup and the post, and establishing a low thermal impedance path between one of the heat sinks and the heat source and the shunt; and maintaining isolation between a second post of the shunt from a second cup by means of an axial isolator wherein the second cup is thermally coupled to the other of the heat sinks.

According to still another aspect of the invention, a method of selectively coupling a heat source to one of a pair of heat sinks includes the steps of: placing first and second cups, coupled to respective of the heat sinks, at least partially around respective first and second posts, wherein the posts are parts of a shunt that is an integral part of the heat source; radially contracting the first cup, thereby causing contact between the first cup and the post, and establishing a low thermal impedance path between one of the heat sinks and the heat source; and maintaining isolation between the second post and the second cup by use of an axial isolator at least partially between the second post and the second cup.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings which are not necessarily to scale.

DETAILED DESCRIPTION

A thermal switch couples a heat source to a pair of heat sinks, such as a primary heat sink and a secondary (redundant) heat sink. The thermal switch includes a shunt that is thermally coupled to the heat source. The shunt has a pair of posts. End portions of the posts are at least partially radially surrounded by respective cups. The cups in turn are thermally coupled to respective of the heat sinks. The cups are made of a material with a larger coefficient of thermal expansion than the material of the posts. Thus thermal contact between the posts and the cups may be controlled by selectively activating one or the other of the heat sinks. Activation of one of the heat sinks cools the cup attached to the active heat sink, causing the cup corresponding to that heat sink to contract, bringing it into contact with the corresponding post of the shunt. This opens a heat path through the switch from the heat source to the activated heat sink. This also causes cooling of the shunt, with the thermal isolator connecting the inactive cup to the shunt facilitating thermal isolation between the switch and the de-activated heat sink. By thermally isolating the shunt from the de-activated heat sink, thermal parasitics may be reduced. The thermal switch provides a way of selectively coupling a heat source to a pair of heat sinks, one or the other of which may be activated, while avoiding undesired thermal parasitics. The switch allows coupling to redundant cooling systems in a reliable way, with small size and a small number of parts.

Figure 1:
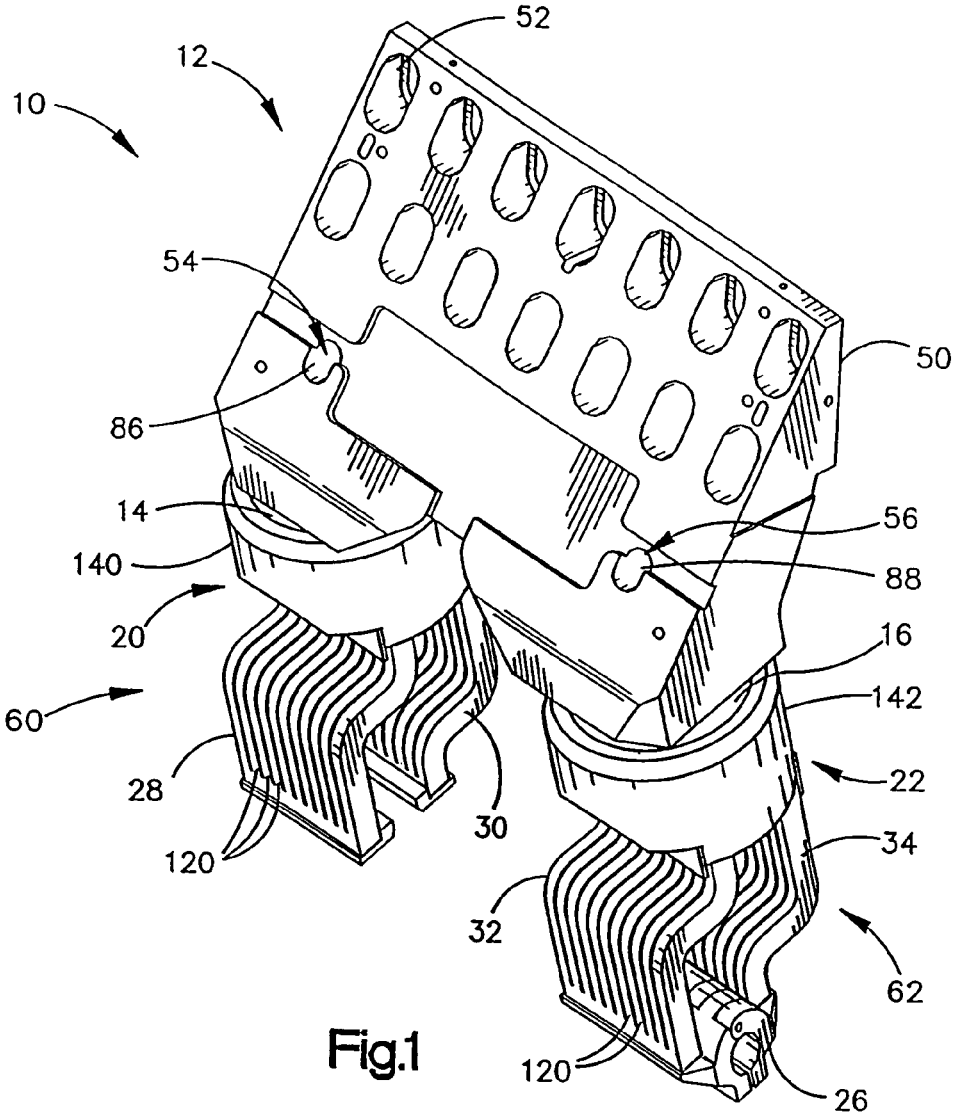
FIG. 1 is an isometric view of a thermal switch in accordance with the present invention.

Referring initially to FIG. 1, a thermal switch 10 includes a shunt 12. The shunt 12 has a pair of posts 14 and 16. End portions of the post are surrounded by respective cups 20 and 22. The cups 20 and 22 are in turn thermally coupled to respective clamps 24 and 26 by flexible straps, with flexible straps 28 and 30 coupling the cup 20 to the clamp 24, and with flexible straps 32 and 34 coupling the cup 22 to the clamp 26.

As explained in greater detail below, the posts 14 and 16 are configured to be selectively brought into contact with the corresponding cups 20 and 22 to provide a switchable thermal path between the shunt 12 and one or other of the clamps 24 and 26. Thus, with reference now to FIG. 2, the switch 10 provides selective thermal coupling between a heat source 40 and a pair of heat sinks 44 and 46. The heat source 40 may be thermally coupled to the shunt 12 by bolting or otherwise bringing into contact with one or more surfaces of the shunt 12, or by incorporating the features of the shunt 12 into the heat source. The shunt 12 may be an integral part of the heat source or device to be cooled. The heat sinks 44 and 46 are thermally coupled to the respective clamps 24 and 26, allowing a thermal path between the heat sinks 44 and 46 and the respective cups 20 and 22. Thus the heat sinks 44 and 46 may be selectively coupled to the heat source 40, providing a pair of potential heat paths for heat produced by the heat source 40. At the same time, the thermal switch 10 may be used to provide a thermal path from the heat source 40 to only one of the heat sinks 44 and 46, while providing an essentially insulative thermal path between the heat source 40 and the other of the heat sinks. Low thermal impedance is provided in the closed state, when the switch 10 is coupled to one of the heat sinks 44 and 46. High thermal impedance is provided in the off state, when the thermal coupling between the switch 10 and the other of the heat sink 44 or 46 is broken. Thus the thermal switch 10 provides a way of thermally coupling the heat source 40 to one or both of a pair of heat sinks 44 and 46. When a single heat sink is active, thermal parasitics through the redundant cooling path may be reduced or held to a minimum by providing high thermal impedance in the off condition between the thermal switch 10 and the unused heat sink 44 or 46.

The heat source 40 represents any of a variety of heat-producing equipment. Examples include heat-producing electronic and optical equipment, although it will be appreciated that many other types of heat-producing equipment or heated surfaces or volumes may be represented by the heat source 40. One application for the switch 10 is the cooling of spacecraft electronic components. Such components are cooled by heat sinks to maintain them at a desired low temperature. In such systems it is desirable to have redundancy in the cooling systems so that if one heat sink breaks down, another heat sink may be used to provide the required cooling, thus maintaining operation of the system. However, it is not efficient to run both heat sinks simultaneously. In addition, it is desirable that any heat sink that is not operating be thermally isolated from the operating heat sink. By thermally isolating a non-operating heat sink, additional heat loads on the operating heat sink may be avoided. Such undesirable heat loads include thermal parasitic heating that may occur due to heat flow from the non-operating heat sink to the operating heat sink.

With reference now in addition to FIGS. 3A–9, details of the thermal switch 10 are discussed. In the discussion herein, certain materials and dimensions are mentioned. It will be appreciated that these materials and dimensions are examples only, and that other materials and/or dimensions may be utilized.

Figure 2:
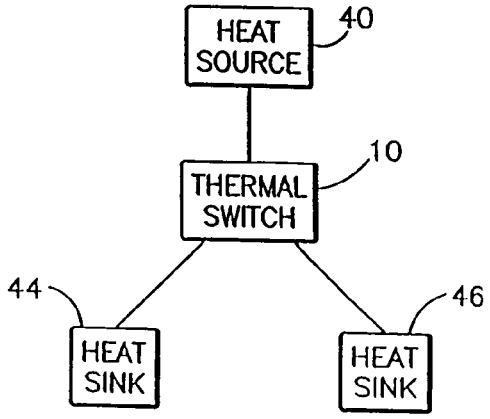
FIG. 2 is a schematic diagram illustrating use of the thermal switch of FIG. 1 in selectively coupling a heat source to one of a pair of heat sinks.

The shunt 12 includes a surface 50 to be bolted to the heat source 40 (FIG. 2). A number of fastener holes 52 in the shunt 12 are used for receiving suitable fasteners to connect the shunt 12 to the heat source 40, pressing the surface 50 against the heat source 40. The shunt 12 also has a pair of counter-bored holes 54 and 56 for coupling the shunt 12 to the cup assemblies 60 and 62. It will be appreciated that the features of the shunt 12 can also be incorporated in the heat source if desired.

Figure 3A:
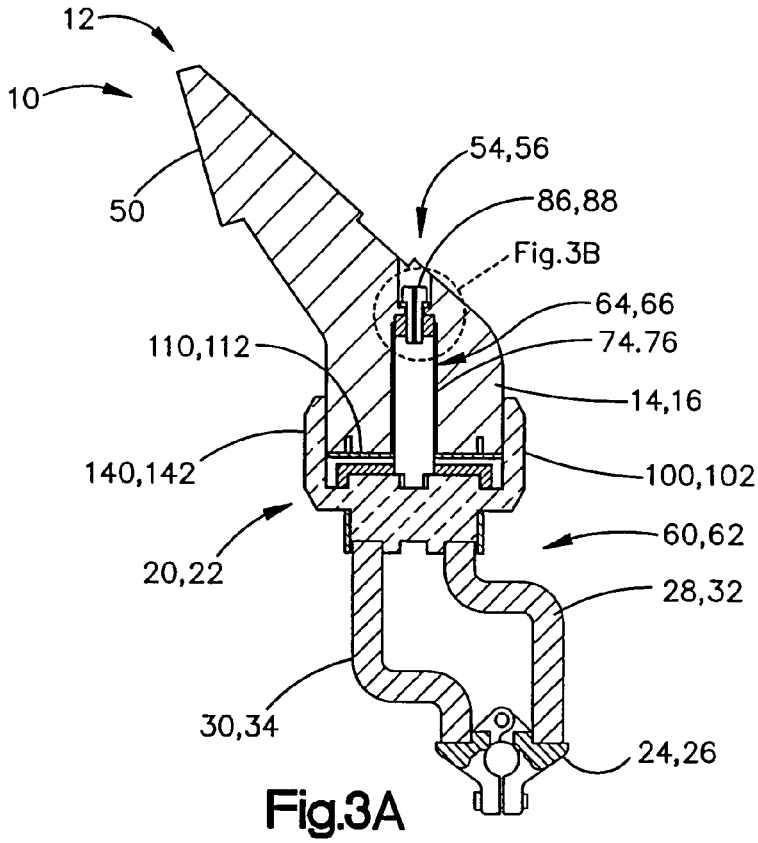
FIG. 3A is a cross-sectional view of the thermal switch of FIG. 1.
Figure 3B:
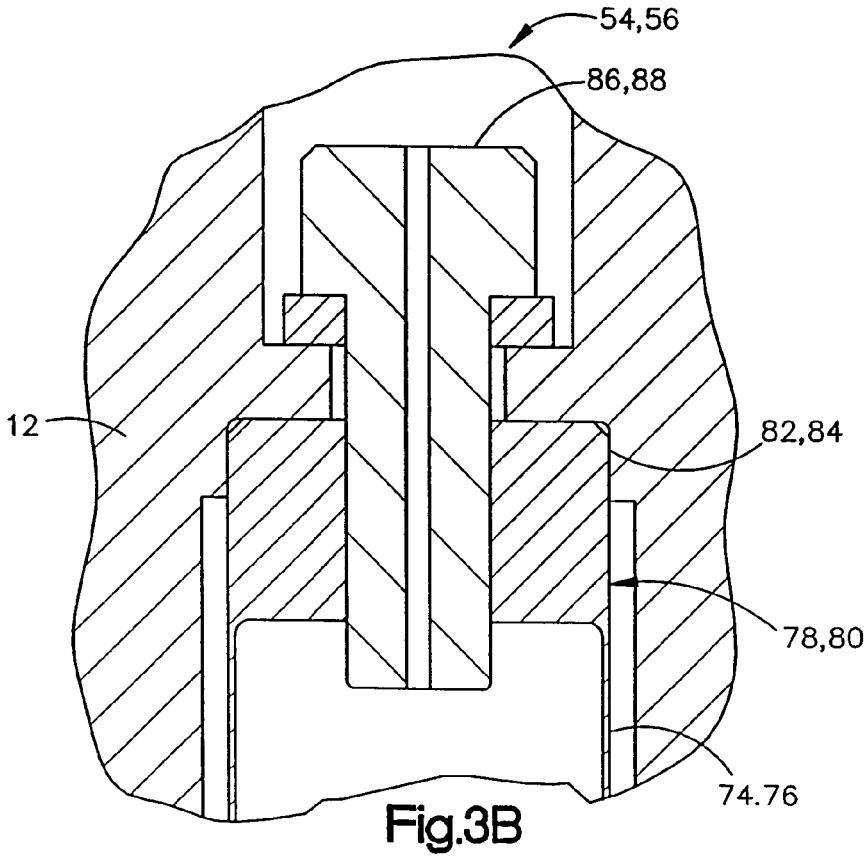
FIG. 3B is a detailed cross-sectional view of the connection between the isolator and the shunt illustrated in FIG. 3.
Figure 4:
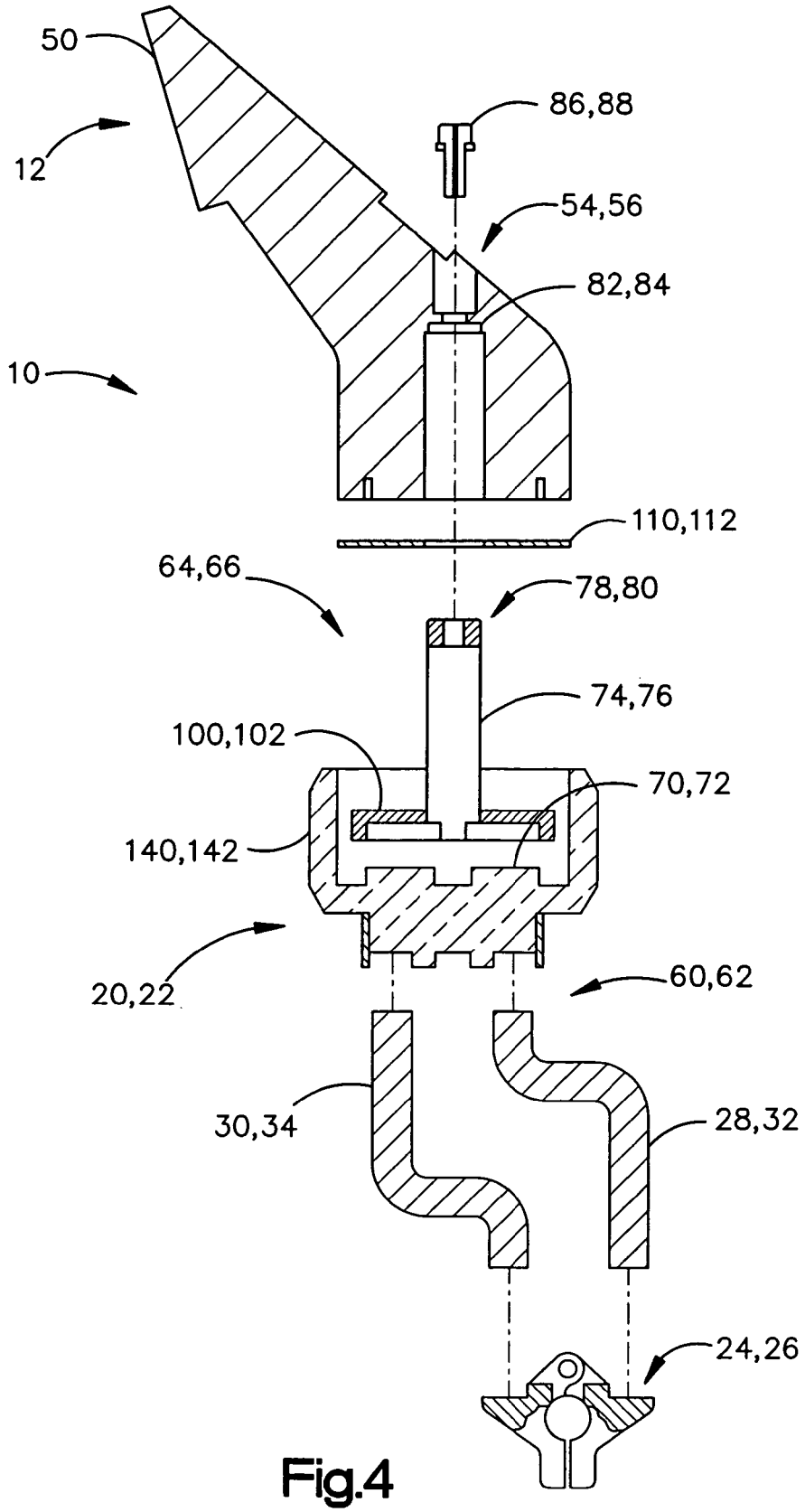
FIG. 4 is an exploded view of the thermal switch of FIG. 1.

The cup assemblies 60 and 62 include respective isolators 64 and 66 that are coupled to bottom surfaces 70 and 72 of the cups 20 and 22. Protruding parts 74 and 76 of the isolators 64 and 66 are inserted into the bottom parts of the holes 54 and 56 in the posts 14 and 16 of the shunt 12. Ends 78 and 80 of the protruding parts 74 and 76 of the isolators 64 and 66 pilot into reduced diameter portions 82 and 84 of the holes 54 and 56, as shown in FIG. 3B. The concentricity of the posts 14 and 16 to the reduced pilot diameter portions 82 and 84 of the holes 54 and 56 is tightly controlled, as is the concentricity of the protruding portions 74 and 76 of the isolators 64 and 66 to the inner bore of the cups 20 and 22, thereby maintaining concentricity of the posts 14 and 16 and the cups 20 and 22. Vented screws 86 and 88 are inserted into the top portions of the holes 54 and 56, and engage the protruding portions 74 and 76 of the isolators 64 and 66, thus attaching the shunt 12 to the cup assemblies 60 and 62.

Each of the protruding portions 74 and 76 of the isolators 64 and 66 may include a hollow portion consisting of a thin-walled tube to serve as a thermal isolator. Radial gaps between the inner bores of the posts 14 and 16 and the protruding portions 74 and 76 of isolators 64 and 66 prevent conduction from the posts 14 and 16 into any portion of the isolators 64 and 66 other than the tip of protrusions 74 and 76. In the off state, all conduction between the shunt 12 and cups 20 and 22 is thereby through the thin-walled tube portions of isolators 64 and 66.

The isolators 64 and 66 have keyed bottom portions 100 and 102 with protrusions 104 for engaging corresponding recesses in the bottom surfaces 70 and 72 of the cups 20 and 22. The bottom portions 100 and 102 of the isolators 64 and 66 may be relatively wide, for example engaging most of the bottom surfaces 70 and 72 of the cups 20 and 22. Bolts 106 are used to secure the isolators 64 and 66 to the cups 20 and 22. The isolators 64 and 66 may be made of a suitable strong material with low thermal conductivity. Alternatively, if the material is strong enough, it will be appreciated that a high thermal conductivity material may be used, with a small enough wall thickness in the protruding portions 74 and 76, so as to minimize thermal conductivity. An example of a suitable material for the isolators 64 and 66 is a titanium alloy. However, it will be appreciated that a wide variety of other materials may be utilized. The isolators 64 and 66 provide an effective way of centering the cups 20 and 22 relative to the posts 14 and 16, without providing a significant thermal path between the posts 14 and 16 and the cups 20 and 22.

Figure 6A:
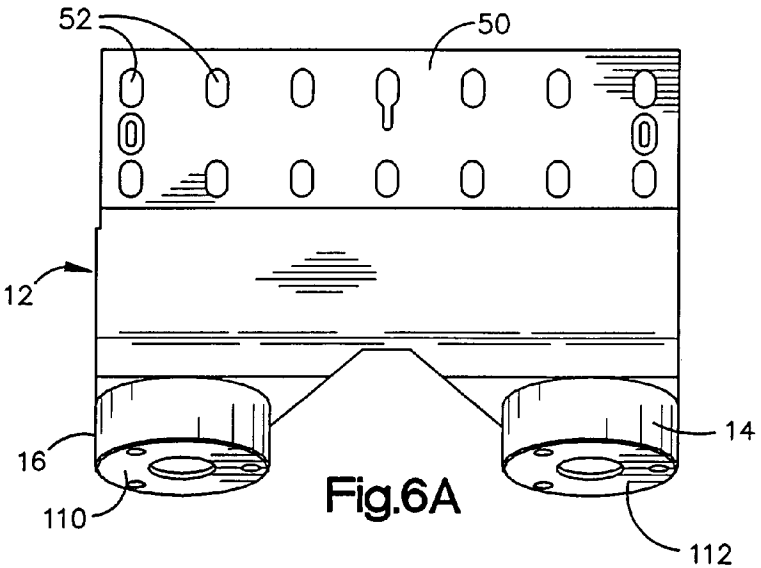
FIG. 6A is a back view of the shunt assembly of FIG. 5.
Figure 5:
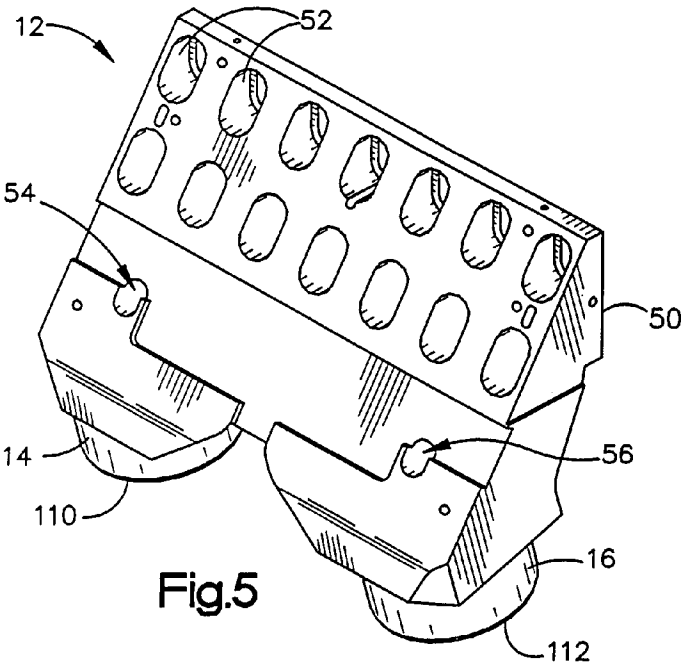
FIG. 5 is an isometric view of the shunt assembly of the thermal switch of FIG. 1.
Figure 7:
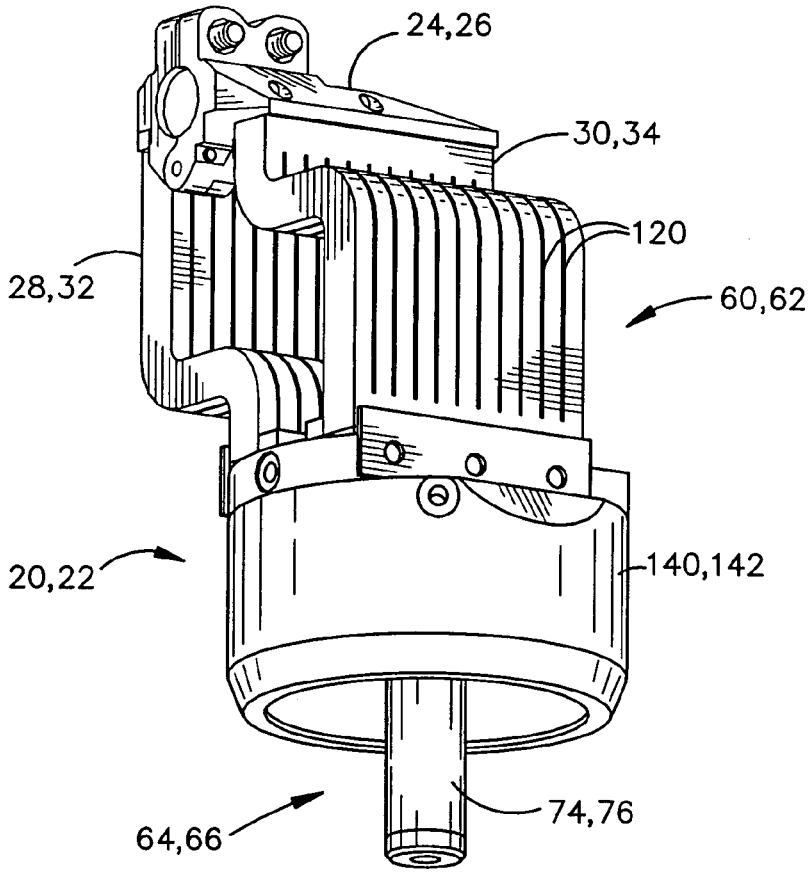
FIG. 7 is an isometric view of a cup assembly of the thermal switch of FIG. 1.
Figure 8:
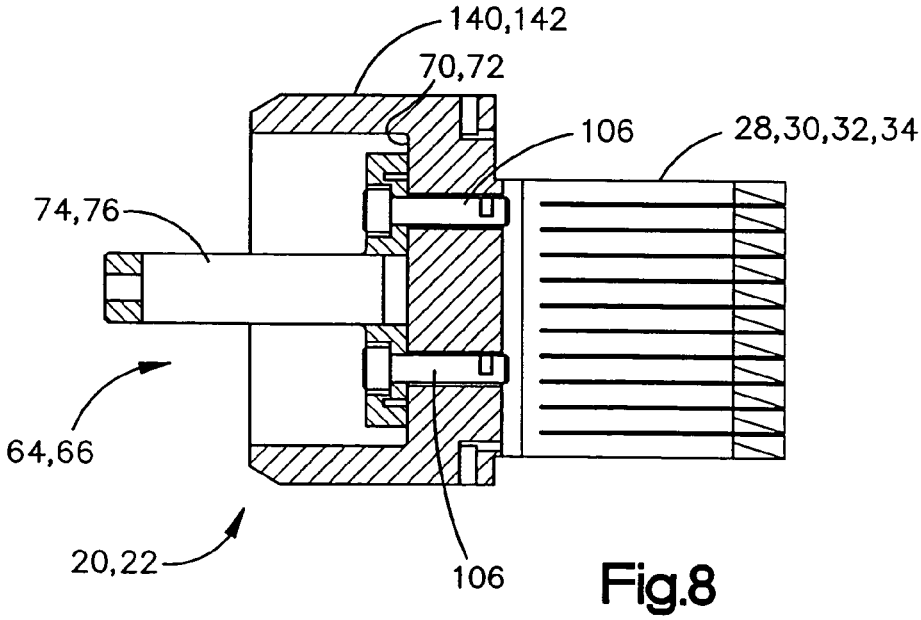
FIG. 8 is a cross-sectional view of the cup assembly of FIG. 7.
Figure 9:
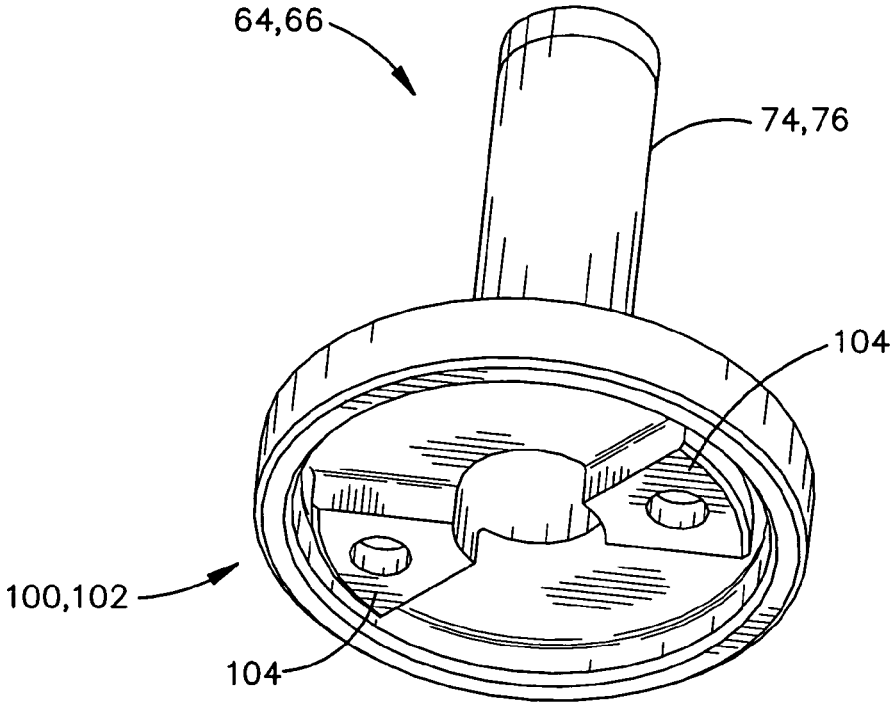
FIG. 9 is an isometric view of the isolator of the cup assembly.
Figure 10:
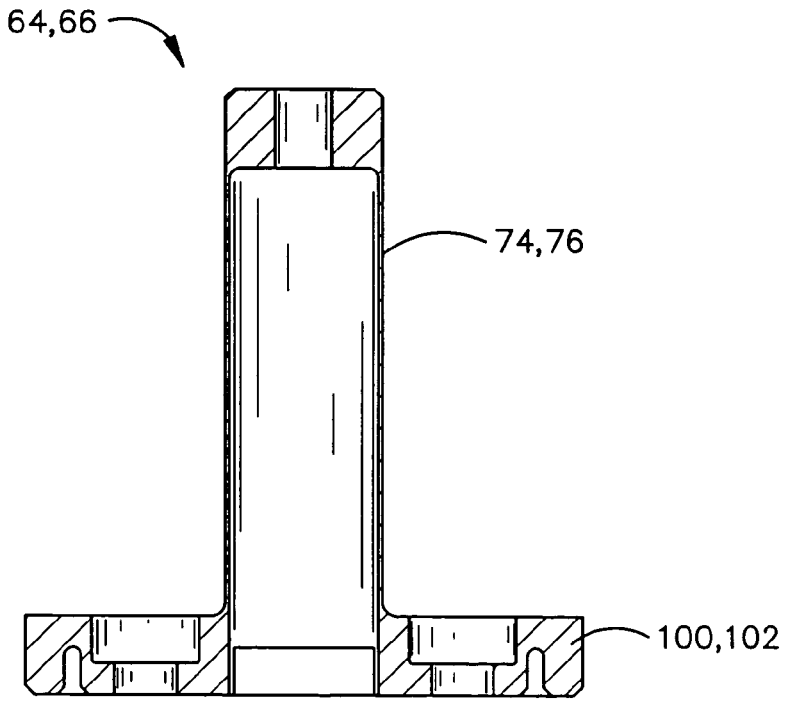
FIG. 10 is a cross-sectional view of the isolator of FIG. 9.

As best seen in FIGS. 5 and 6A, anti-rattle disks 110 and 112 may be provided at the ends of the posts 14 and 16. The anti-rattle disks 110 and 112 may be made of a flexible polymer material, such as a polyimide marketed under the trademark KAPTON. The anti-rattle disks 110 and 112 aid in damping vibration-induced rattling of the cups 20 and 22 and the posts 14 and 16, thereby preventing damage to the cups 20 and 22 and posts 14 and 16. The anti-rattle disks 110 and 112 have an outside diameter larger than posts 14 and 16 and smaller than the inside diameter of cups 20 and 22, may have a thickness of about 0.06 inches (1.5 mm), and may be supported on three small lands at the ends of posts 14 and 16. Concentricity of the posts 14 and 16 and the anti-rattle disks 110 and 112 is tightly controlled to prevent contact between the anti-rattle disks 110 and 112 and the cups 20 and 22 in the "off" state under static conditions. It is desirable that the disks have a coefficient of thermal expansion greater than that of the cup such that in the "on" state, the anti-rattle disk tends to shrink away from the cup.

Figure 6B:
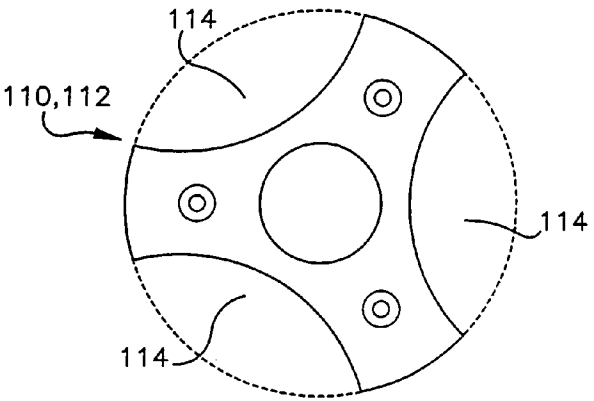
FIG. 6B is a plan view of one possible configuration of the anti-rattle disks of the shunt assembly of FIG. 5.

The disks 110 and 112 may have circular shapes, as shown in FIG. 6A. Alternatively, as shown in FIG. 6B, the disks 110 and 112 may have cutouts 114 of removed material in the disk shapes, so that the shape of the disks 110 and 112 is other than circular. The cutouts 114 may be of any of a variety of suitable shapes. The cutouts 114 may reduce the amount of material in the disks 110 and 112, and may reduce the thermal conduction through the disks 110 and 112.

The flexible straps 28–34 of the cup assemblies 60 and 62 may be made of a flexible sheet metal, such as aluminum that is 0.002 inches (0.05 mm) thick. Middle portions of the flexible straps 28–34 may have slots 120 cut therein. The slots 120 may facilitate movement of the flexible straps 28–34 along the axis of clamps 24 and 26. It will be appreciated that other suitable materials may be utilized for the flexible straps 28–34.

The flexible straps 28–34 may be coupled to the to the cups 20 and 22, and to the clamps 24 and 26 by electron beam welding. Other suitable methods including, but not limited to, diffusion bonding or brazing may be used.

The cups 20 and 22 surround end portions of the posts 14 arid 16. The cups 20 and 22 are made of a material with a higher coefficient of thermal expansion than the material of the posts 14 and 16. For example, the cups 20 and 22 may be made of aluminum, and the shunt 12 (including the posts 14 and 16) may be made of beryllium. Suitable alternative materials for the cups 20 and 22 include copper and magnesium. It will be appreciated that a wide variety of other material combinations may be utilized. It is desirable that the materials of the shunt 12 and the cups 20 and 22 have high thermal conductivity. In addition, it is desirable that there be a significant difference in the coefficient of thermal expansion between the material of the cups 20 and 22, and the material of the posts 14 and 16.

As one of the heat sinks 44 and 46 (FIG. 2) is activated, the cup assembly 60 or 62 corresponding to that heat sink becomes cooled as well. For example, if the heat sink 44 is activated, the clamp 24, which is coupled to the heat sink 44, is also cooled. This in turn cools the flexible straps 28 and 30, and then the cup 20. Cooling the cup 20 causes the cup 20 to contract. This causes an annular portion 140 of the cup 20 to radially contract, reducing its inner diameter, and pressing the annular portion 140 against the post 14 of the shunt 12. This "closes" the thermal connection between the shunt 12 and the cup assembly 60, thereby providing a low thermal impedance path through the switch 10 between the heat source 40 and the heat sink 44. It will be appreciated that the gap between the annular portion 140 and the post 14 may be sized such that sufficient pressure between the annular portion 140 and the post 14 occurs when the heat sink 44 is operated.

The gap between cups 20 and 22 and posts 14 and 16 may be inherently small, making the impact of manufacturing tolerances on contact temperature and pressure significant. The effect of tolerances can be minimized by maximizing the room temperature radial gap, g, between the cups 20 and 22 and posts 14 and 16. Let $g=R_2-R_1$ where $R_2$ is the cup inside radius and $R_1$ is the post outside radius. Typical design constraints include a desired operating pressure, p, and limited packaging volume resulting in a maximum allowable cup outside radius, $R_o$. The gap equation consists of a radial thermal contraction term, $g_a$, and a radial interference term, $g_b$, as follows:

$$g_a = \int_{T_1}^{T_0} (\alpha_o(T) - \alpha_i(T))R\,dT$$

$$g_b = \frac{pR}{E_i}\left(\frac{R^2 + R_i^2}{R^2 - R_i^2} - \nu_i\right) + \frac{pR}{E_o}\left(\frac{R_o^2 + R^2}{R_o^2 - R^2} - \nu_o\right)$$

$$g = g_a - g_b$$

where $T_1$ is the operating temperature, $T_0$ is room temperature, $\alpha_o$ is the coefficient of linear thermal expansion (CTE) for the cup, $\alpha_i$ is the CTE for the post, R is the transition radius which can be approximated by $R_1$, $E_i$ is the elastic modulus of the post, $E_o$ is the elastic modulus of the cup, $R_i \geqq 0$ is the inside radius of the post, $\nu_i$ is the Poisson's ratio of the post, and $\nu_o$ is the Poisson's ratio of the cup. The maximum room temperature gap, $g_{max}$, can be found by setting the derivative of g with respect to R to zero and solving for R. The gap can be distributed as desired between the cup and post, for example setting $R_1=R$ and $R_2=R_1+g_{max}$. The resulting geometry should be verified to provide a sufficiently low closure temperature to prevent the switch from engaging when a heat sink is not operating and the shunt is at its operating temperature. An excessively high engagement temperature will necessitate a change in material selection, operating pressure, or packaging volume.

In an example embodiment, the posts 14 and 16 may have a diameter of about 2 inches (5 cm), and the annular portions 140 and 142 of the cups 20 and 22 may be slightly larger. The room-temperature gap between the posts 14 and 16 and the annular portions 140 and 142 may be about 0.0025 inches (0.06 mm). The gap between the posts 14 and 16 and the annular portions 140 and 142 may be configured such that initial contact is made at a temperature of about 150 K, and at 60 K the contact pressure between the post and the cup may be at least about 1,000 psi throughout the cup-post interface. If the gap between the cup and post is configured to allow initial contact at 110 K, the cup-post pressure at 60 K may be at least about 500 psi. It will be appreciated that these numbers correspond to exemplary embodiments of the invention, and that a wide variety of other sizes and operating temperatures and/or pressures may be utilized.

No material is required in the gap between the posts 14 and 16 and the annular portions 140 and 142 of the cups 20 and 22, to maintain the uniform gap. It will be appreciated that this advantageously provides no direct contact that would allow thermal flow across the gap.

The thermal switch 10 described above utilizes posts 14 and 16 with end portions that are fully surrounded by the annular portions 140 and 142 of the cups 20 and 22. It will be appreciated that many variations of the above design are possible. For example, the posts and cups may have cross sections that are other than circular, while still maintaining the basic radial coupling between the posts and the cups. Also, the cups need not fully surround the posts, but may instead only partially surround the posts. Another possible configuration is a rectangular cross-section post between two slabs that together function as a cup.

Further, it will be appreciated that other alternatives exist for utilizing the basic idea of radial thermal coupling between materials having different coefficients of expansion. For example, it will be appreciated that the principles of operation described above may be utilized in the thermal switch that couples one or more heat sources to more than two heat sinks. As another alternative, it will be appreciated that a thermal switch may be configured for selectively coupling a heat source to a single heat sink. Indeed, it will be appreciated that the radial coupling described above may be utilized as a sort of thermostat, for example, by activating a thermal path only when a predetermined amount of heating (expanding a post) and/or a predetermined amount of cooling (contracting a cup) is achieved. Such a thermal switch may be configured to thermally isolate a heat source until such time as a predetermined amount of heating is built up. Once this predetermined amount of heat (predetermined temperature) is reached, a post that is thermally coupled to the heat sourced may expand sufficiently to provide sufficient contact to a cup that is coupled to a heat sink.

As yet another alternative, it will be appreciated that a thermal switch may be configured so as to selectively couple one out of multiple heat sources, to one or more heat sinks. For example, individual heat sources may be thermally coupled to respective posts that are in turn at least partially radially surrounded by respective cups that are thermally coupled to a single heat sink. Thermal paths from either of the heat sources to the cold source may thus automatically be switched by heating in the heat sources. In this application, it is desirable that the posts have a greater CTE than the cups, but the principle of operation is unchanged.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A thermal switch comprising:

a shunt in contact with a heat source, said shunt including a post thermally coupled to said heat source;

a cup thermally coupled to a heat sink, wherein the cup includes an annular portion at least partially surrounding a portion of the post, leaving a gap therebetween; and an axial isolator coupled to the cup and the post, for maintaining the radial gap between the post and the annular portion of the cup;

wherein the cup and the post have different coefficients of linear thermal expansion, such that the post and the annular portion selectively thermally couple together depending on temperatures of the annular portion and the post.

2. The thermal switch of claim 1, wherein the post is a first post, wherein the cup is a first cup; and wherein the shunt further includes a second cup with a second annular portion at least partially surrounding a portion of a second post.

3. The thermal switch of claim 2, wherein the cups are thermally coupled to respective heat sinks; and wherein the thermal switch allows disengagement of one of the cups when the heat sink coupled to the other of the cups is in operation.

4. The thermal switch of claim 1, wherein the shunt is an integral part of the device to be cooled.

5. The thermal switch of claim 1, wherein the cup includes aluminum.

6. The thermal switch of claim 1, wherein the post includes beryllium.

7. The thermal switch of claim 1, wherein the post has a circular cross-section.

8. The thermal switch of claim 1, wherein the annular portion fully radially surrounds the portion of the post.

9. A thermal switch comprising:

a post thermally coupled to a heat source;

a cup thermally coupled to a heat sink, wherein the cup includes an annular portion at least partially surrounding a portion of the post, leaving a gap therebetween;

an axial isolator coupled to the cup and the post, for maintaining the radial gap between the post and the annular portion of the cup; and a polymer disk between the cup and an end of the posts;

wherein the cup and the post have different coefficients of linear thermal expansion, such that the post and the annular portion selectively thermally couple together depending on temperatures of the annular portion and the post.

10. The thermal switch of claim 9, wherein the disk have cutouts such that its shape is other than circular.

11. A thermal switch comprising:

a post thermally coupled to a heat source;

a cup thermally coupled to a heat sink, wherein the cup includes an annular portion at least partially surrounding a portion of the post, leaving a gap therebetween; and an axial isolator coupled to the cup and the post, for maintaining the radial gap between the post and the annular portion of the cup;

wherein the cup and the post have different coefficients of linear thermal expansion, such that the post and the annular portion selectively thermally couple together depending on temperatures of the annular portion and the post; and wherein the gap between the cup and the post conforms to the equations:

$$g_a = \int_{T_1}^{T_0} (\alpha_o(T) - \alpha_i(T))R\,dT$$

$$g_b = \frac{pR}{E_i}\left(\frac{R^2 + R_i^2}{R^2 - R_i^2} - \nu_i\right) + \frac{pR}{E_o}\left(\frac{R_o^2 + R^2}{R_o^2 - R^2} - \nu_o\right)$$

$$g = g_a - g_b$$

wherein $R_2$ is an inside radius of the cup, $R_1$ an outside radius of the post, g is the gap between the cup and the post ($g=R_2-R_1$), p is a desired operating pressure, $R_o$ is a maximum allowable cup outside radius, $g_n$ is a radial thermal contraction term, $g_b$ is a radial interference term, $T_1$ is an operating temperature, $T_0$ is an ambient temperature, $\alpha_o$is the coefficient of linear thermal expansion (CTE) for the cup, $\alpha_i$ is the CTE for the post, R is a transition radius which can be approximated by $R_1$, $E_i$ is an elastic modulus of the post, $E_o$ is an elastic modulus of the cup, $R_i$ is an inside radius of the post, $\nu_i$ is Poisson's ratio of the post, and $\nu_o$ is Poisson's ratio of the cup.

12. A thermal switch comprising:

a shunt thermally coupled to a heat source, wherein the shunt includes having a pair of posts thermally coupled to one another;

a pair of cups thermally coupled to respective heat sinks, wherein the cups include respective annular portions at least partially surrounding portions of the posts, leaving respective gaps therebetween; and a pair of an axial isolators coupling the cups to the respective posts, for maintaining the radial gaps between the posts and the annular portions of the cups;

wherein the annular portions have a lower coefficient of thermal expansion than the shunt, such that the posts and the annular portion selectively thermally couple together depending on temperatures of the annular portions and the posts.

13. The thermal switch of claim 12, wherein the shunt is an integral pert of the device to be cooled.

14. The thermal switch of claim 12, wherein the pair of posts are part of a single piece of material.

15. The thermal switch of claim 14, wherein the single piece of material includes beryllium.

16. The thermal switch of claim 15, wherein annular portions of the cups include aluminum.

17. The thermal switch of claim 12, wherein the cups include respective isolators; and wherein the isolators are inserted into recesses in the posts, in order to maintain the gaps between the posts and the annular portions.

18. The thermal switch of claim 17, wherein the isolators include respective titanium protruding portions.

19. The thermal switch of claim 12, further comprising disks of material between the cups and ends of the posts.

20. The thermal switch of claim 19, wherein the disks include a polymer material.

21. The thermal switch of claim 19, wherein the disks have cutouts such that their shape is other than circular.

22. The thermal switch of claim 12, wherein the annular portions fully radially surround the portions of the posts.

23. A method of selectively coupling a heat source to one of a pair of heat sinks, the method comprising:

thermally coupling the heat source to a shunt;

radially contracting a first cup at least partially around a first post of a shunt, thereby causing contact between the first cup and the post, and establishing a low thermal impedance path between one of the heat sinks and the heat source and the shunt; and maintaining isolation between a second post of the shunt from a second cup by means of an axial isolator wherein the second cup is thermally coupled to the other of the heat sinks.

24. A method of selectively coupling a heat source to one of a pair of heat sinks, the method comprising:

placing first and second cups, coupled to respective of the heat sinks, at least partially around respective first and second posts, wherein the posts are parts of a shunt that is an integral part of the heat source;

radially contracting the first cup, thereby causing contact between the first cup and the post, and establishing a low thermal impedance path between one of the heat sinks and the heat source; and maintaining isolation between the second post and the second cup by use of an axial isolator at least partially between the second post and the second cup.

* * * * *